US005465558A

United States Patent [19]

Dreger

[11] Patent Number: 5,465,558

[45] Date of Patent: Nov. 14, 1995

[54] WEB CREASER

[75] Inventor: Douglas D. Dreger, New Holstein, Wis.

[73] Assignee: Hayssen Manufacturing Company, Sheboygan, Wis.

[21] Appl. No.: 447,827

[22] Filed: May 23, 1995

Related U.S. Application Data

[63] Continuation of Ser. No. 147,153, Nov. 3, 1993, abandoned.

[51] Int. Cl.[6] ..... B65B 9/00; B65B 9/06

[52] U.S. Cl. ..... 53/551; 53/451

[58] Field of Search ..... 53/450, 451, 550, 53/551, 552, 554, 389.3, 389.4; 493/295, 302, 396, 397, 402, 403, 178, 152, 153, 162, 269, 308, 243

[56] References Cited

U.S. PATENT DOCUMENTS

| | | | |
|---|---|---|---|
| 2,248,471 | 7/1941 | Stroop | 53/451 |
| 3,149,447 | 9/1964 | Dorr | 53/551 |
| 4,117,649 | 10/1978 | Egli | 53/552 |
| 4,120,323 | 10/1978 | Saul | 493/396 |
| 4,260,446 | 4/1981 | Saul | 493/302 |
| 4,330,351 | 5/1982 | Lo Maglio | 53/550 |
| 4,442,656 | 4/1984 | Wylie, Sr. | 53/552 |
| 4,727,709 | 3/1988 | Zieke et al. | 53/551 |
| 4,829,745 | 5/1989 | Behr et al. | 53/551 |

*Primary Examiner*—John Sipos
*Assistant Examiner*—Rodney Butler
*Attorney, Agent, or Firm*—Lee, Mann, Smith, McWilliams, Sweeney & Ohlson

[57] ABSTRACT

A method and apparatus for forming one or more longitudinal creases in a web of material. The web is formed into a tube in a vertical form, fill and seal apparatus, and then passed over an internal guide. A pair of pinch rolls are located adjacent the guide, and a portion of the web is directed between the pinch rolls to crease the film as it is advanced. Direction of the film between the pinch rolls is accomplished by a pair of protrusions extending from the internal guide on opposite sides of the pinch rolls. The thus-creased tube is then passed over opposite, spaced forming plates at the bottom of the guide and then tucked and sealed.

8 Claims, 4 Drawing Sheets

WEB CREASER

This application is a continuation, of application Ser. No. 147,153, filed Nov. 3, 1993, now abandoned.

BACKGROUND OF THE INVENTION

This invention relates to packaging methods and apparatus, and more particularly to a method and apparatus for forming at least one longitudinal crease in the tube of packaging material in a vertical form, fill and seal packaging apparatus to facilitate formation of packages with a rectangular cross section and/or with flat ends.

For many years, flat bottom packages have been formed from a tube in a vertical form, fill and seal packaging apparatus. In such apparatus score lines are sought to be formed in the advancing tube by applying pressure to the tube with grooved rollers pressing the film of the tube against a sharp corner of an internal guide over which a tube is passing, a process known as scoring. While such apparatus produces lines of weakness in the film which will fold along these lines of weakness, under certain conditions the film is mechanically ruptured with this method. Under any circumstance the film along these score lines is degraded and the barrier properties of the film reduced. If too much pressure is applied, since a relatively sharp corner is used for application of pressure against the film, the film can weaken to the point of severing along the score line.

The present invention eliminates these undesirable conditions by folding the packaging material back onto itself i.e. 180 degrees and ironing in the crease, similar to folding a piece of paper back over itself and running the paper between finger and thumb. Any weakening of packaging material by this method is only that inherent in the material itself.

Vertical form, fill and seal apparatus has been used for many years. For example, U.S. Pat. No. 4,288,965, the disclosure of which is incorporated herein by reference, relates to one type of form, fill and seal apparatus and process for a web of flexible plastic material. In this apparatus, the web is guided over a forming shoulder to form the web into a tube. The tube is then fed intermittently downwardly over an internal guide, longitudinally sealed at its bottom, filled with a product, and then sealed and severed into individual packages each containing a measured quantity of the packaged product. U.S. Pat. No. 4,288,965 is assigned to Hayssen Manufacturing Company, assignee of the present application and assignee of many patents and applications relating to such methods and apparatus.

SUMMARY OF THE INVENTION

The present invention comprises a means for forming at least one longitudinal crease in a tube formed in an apparatus for forming, filling and sealing packages wherein a web of flexible package material is fed from a supply and formed into the tube which is advanced vertically. The tube advances over an internal guide, and product to be packaged in the packaging material is periodically introduced into the tube, the tube is then sealed, and the filled and sealed portion of the tube is then severed from succeeding portions of the tube. In accordance with the invention, the means for forming at least one longitudinal crease in the tube comprises a pair of pinch rollers located adjacent the tube. Means is provided for mounting the rollers for contact with one another, and means is provided for directing a portion of the tube between the pinch rollers to crease the tube as the tube is advanced vertically.

In accordance with the preferred form of the invention, the mounting means comprises a yoke for each pinch roller, and includes further means for biassing the rollers toward one another. At least one of the yokes is pivotal, and the biassing means comprises an extension spring connected between the two yokes carrying the pinch rollers.

The means for directing a portion of the tube between the pinch rollers comprises a protrusion extending from the internal guide in alignment with the rollers. In accordance with the preferred form of the invention, a pair of the protrusions is provided, spaced on opposite sides of the rollers, with the protrusions being aligned with one another to accurately direct a portion of the tube between the pinch rollers.

For properly positioning the creased tube for folding in the apparatus of the invention, opposite spaced forming plates are secured to the bottom end of the internal guide. The plates are shaped and sized to extend between spaced creases formed in the tube, so that the tube is firmly held in place as the bottom is tucked. In this instance, four pairs of the pinch rollers are used to form four creases in the tube at the four desired corners of the ensuing package.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
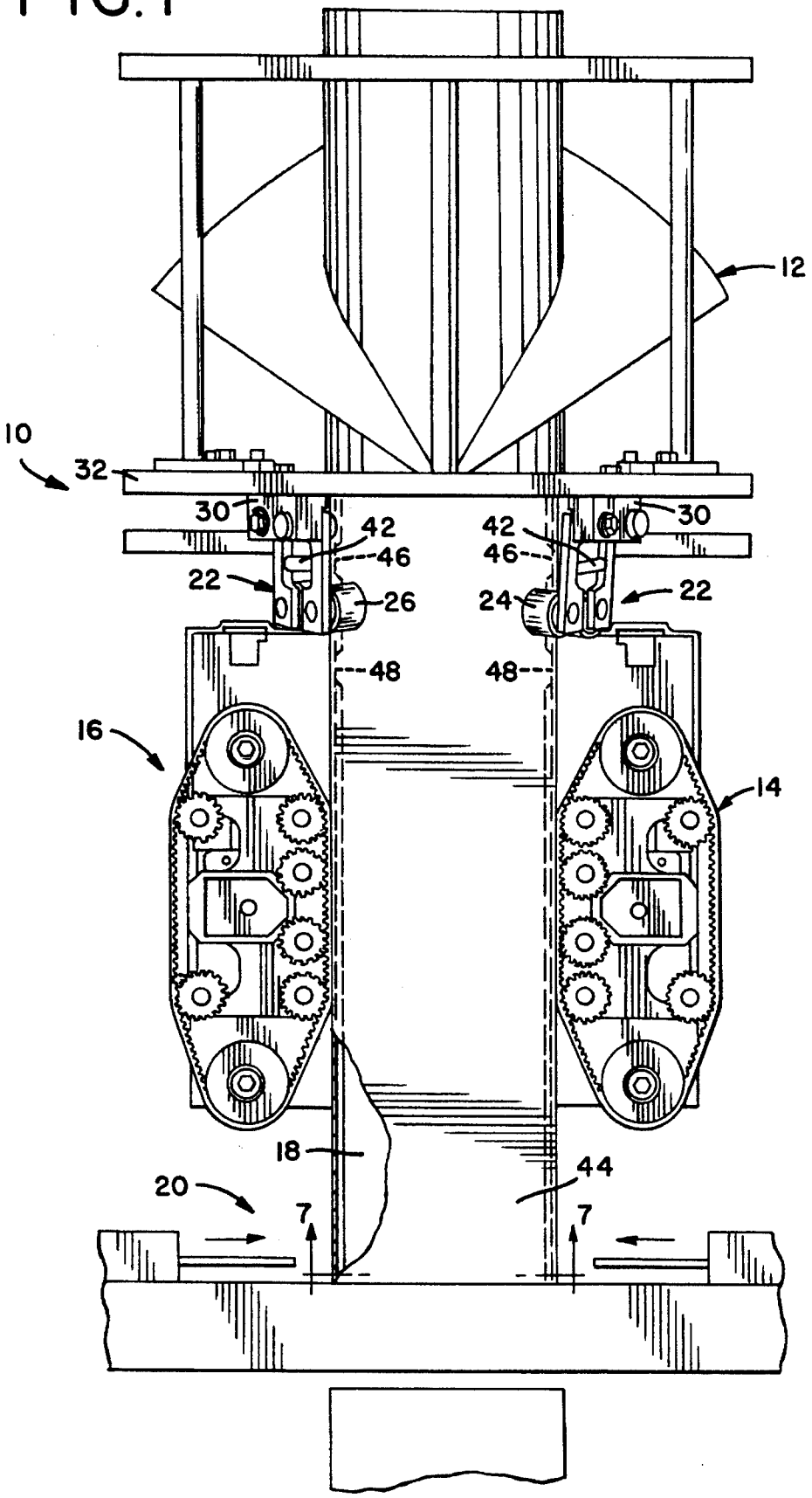
FIG. 1 is an elevational view of a form, fill and seal apparatus according to the invention, with only a portion of a film tube being shown about the internal guide, and with that portion being broken away to illustrate detail, and further illustrating two pairs of pinch rollers according to the invention.
Figure 2:
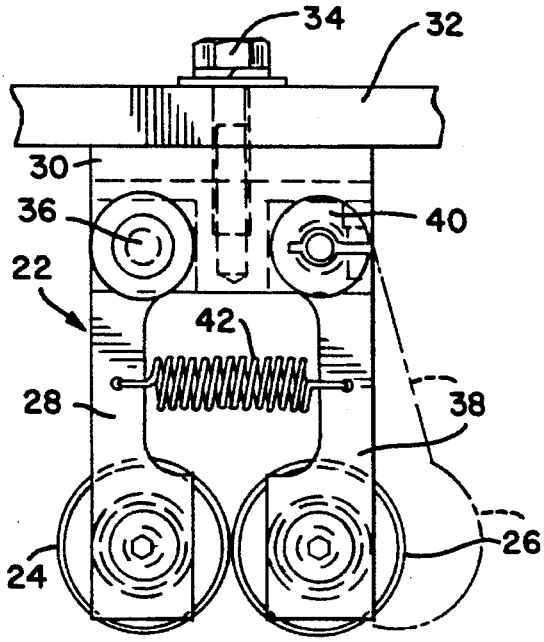
FIG. 2 is an enlarged front elevational view of one pair of pinch rollers according to the invention.

FIG. 1 illustrates a form, fill and seal apparatus, shown generally at 10, which can be used in conjunction with the apparatus and process according to the invention for forming longitudinal creases in sealed packages. The apparatus 10 is as generally illustrated and described in incorporated U.S. Pat. No. 4,288,965. The apparatus 10 draws a plastic web (not illustrated) from a roll thereof, forms the web into a tube over a forming shoulder 12, and the tube is longitudinally sealed as it progresses (means not illustrated). A pair of endless tube feeding belt arrangements 14 and 16 feed the tube from the forming shoulder 12 over an internal guide 18 to a sealing apparatus 20, where the tube is tucked and sealed in a conventional fashion. The elements 12 through 20 of the form, fill and seal apparatus 10 may be conventional, and are therefore not described in greater detail. Use of the form, fill and seal apparatus 10 of FIG. 1 to fill and seal packages is also conventional, and also is not described in greater detail.

The apparatus for forming longitudinal creases in a web of flexible packaging material is best shown in FIGS. 2 through 7. Each crease is formed by a creasing device 22 comprising a pair of pinch rollers 24 and 26 located with their rotational axis horizontal when in an operative orientation (as illustrated in FIG. 1).

The pinch roller 24 is mounted for rotation in a yoke 28 extending from a bracket 30. The bracket 30 is, in turn, secured to a plate 32 of the apparatus 10 by a bolt 34. The roller 24 and yoke 28 are fixed in place relative to the bracket 30 by means of a bolt 36 passing through and securing the yoke 28 to the bracket 30.

Similarly, the pinch roller 26 is mounted in a yoke 38 which is pivotally secured to the bracket 30 by a pivot arrangement 40. An extension spring 42, extending between the yokes 28 and 30, biases the yoke 38 toward the yoke 28 such that the pinch rollers 24 and 26 are firmly in contact with one another.

Figure 4:
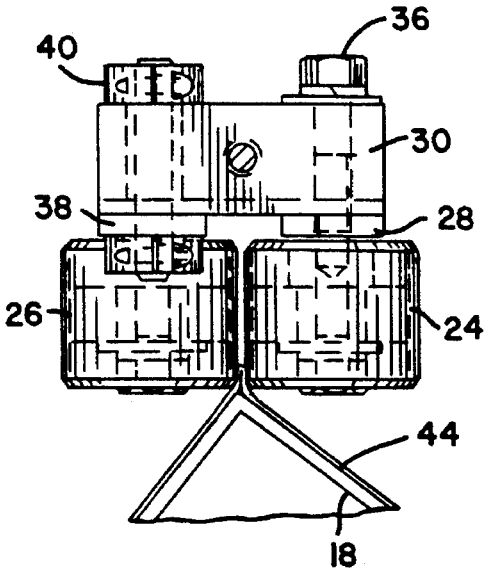
FIG. 4 is an enlarged top plan view of a pair of pinch rollers such as that illustrated in FIG. 2, showing creasing of a web of material between the pinch rollers.
Figure 3:
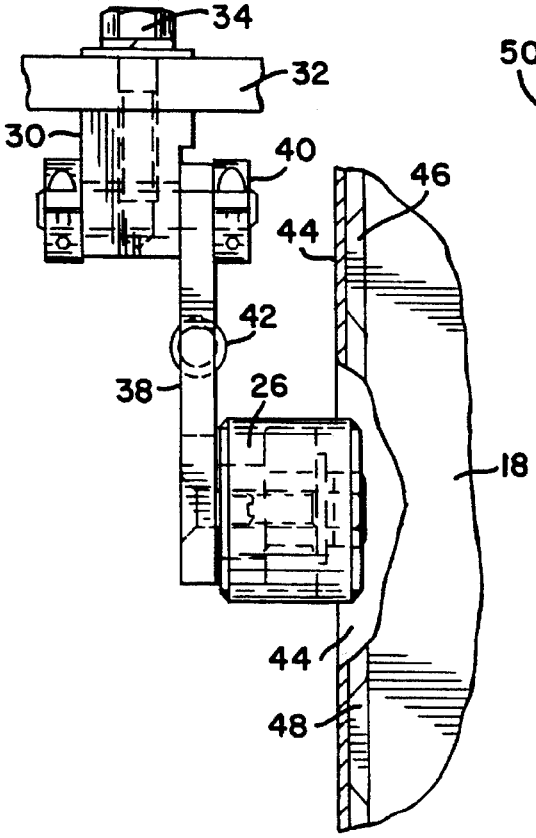
FIG. 3 is an enlarged side elevational view of a pair of pinch rollers such as that shown in FIG. 2, when pinching a tube, and with a portion of the tube broken away to illustrate detail.

For directing the web of flexible packaging material of a tube 44 between the pinch rollers 24 and 26, a pair of protrusions 46 and 48 extend from the internal guide 18 on opposite sides of each pair of the rollers 24 and 26. As best as shown in FIG. 3, the protrusions 46 and 48 extend sufficiently so that the tube 44 is pinched between the rollers 24 and 26, thereby creasing the tube 44 (as shown in FIG. 4) as it passes between the rollers 24 and 26. For each of the creasing devices 22, at least one protrusion 46, and preferably both protrusions 46 and 48, are utilized to properly direct the film of the tube 44 between each pair of pinch rollers 24 and 26.

Figure 5:
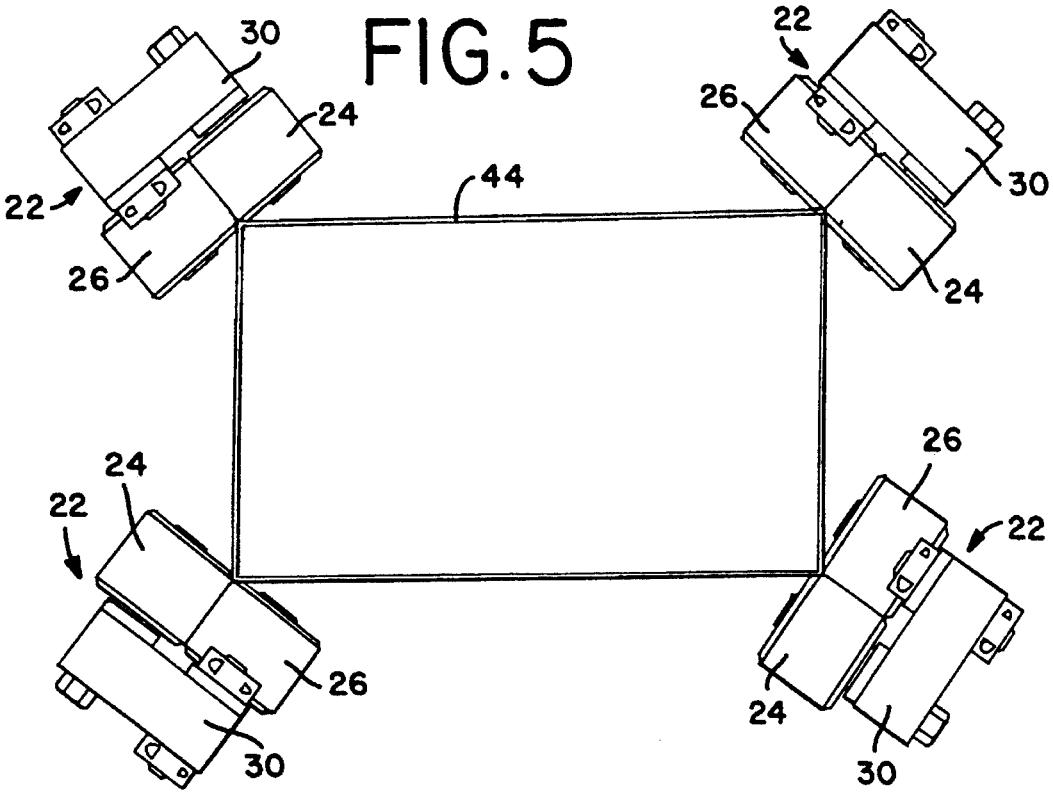
FIG. 5 is a schematic illustration of four pairs of pinch rollers used to form four longitudinal creases in a rectangular tube of film.
Figure 6:
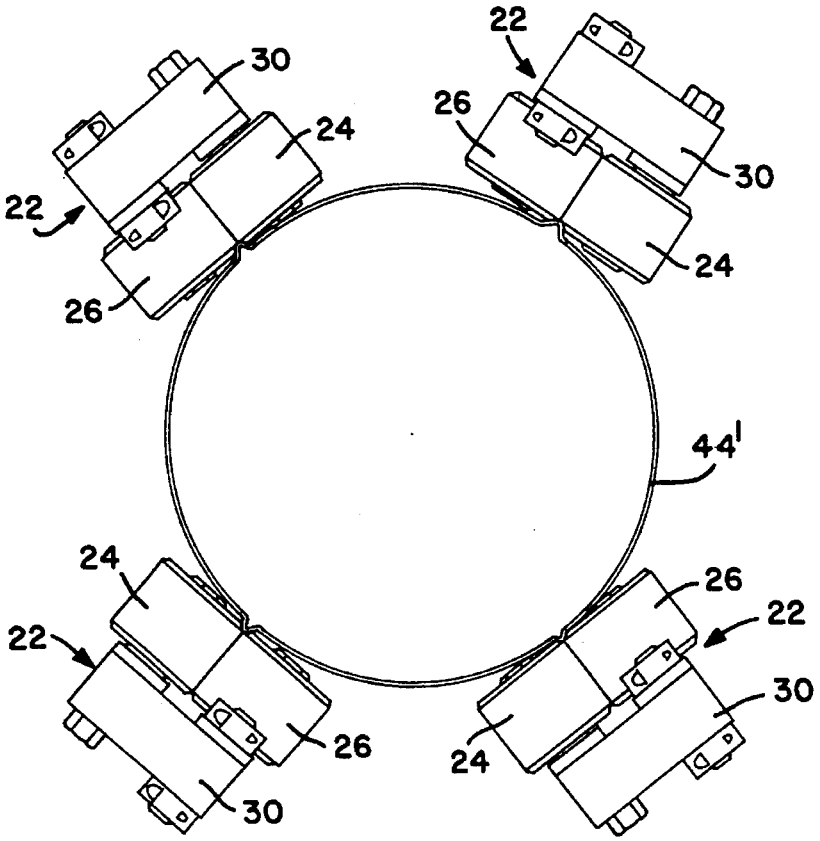
FIG. 6 is a view similar to FIG. 5, showing four pairs of pinch rollers to form four longitudinal creases in a tube of generally circular configuration, and FIG. 7.is a bottom plan view, taken along lines 7—7 of FIG. 1, illustrating the opposite forming plates at the bottom of the internal guide.

The creasing devices 22 can be used in conjunction with a form fill and seal apparatus 10 to form creases in any shape of tube or web. For example, as illustrated schematically in FIG. 5, a rectangular tube 44 is formed with creases in the four corners thereof by means of four of the creasing devices 22. FIG. 6 is similar, but showing creases being formed by four of the creasing devices 22 in conjunction with a circular tube 44'. Other shapes of tubes can be creased, as appropriate.

Figure 7:
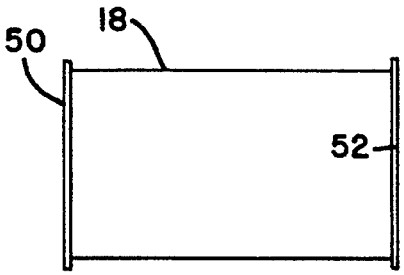
Figure 4A:
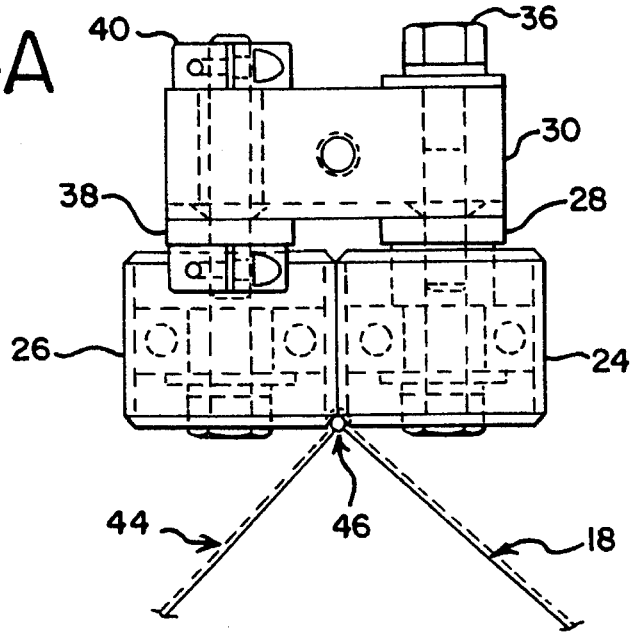
FIG. 4A is a top view showing the protrusions that extend from the internal guide that guides the web of material between the pinch rollers.
Figure 4B:
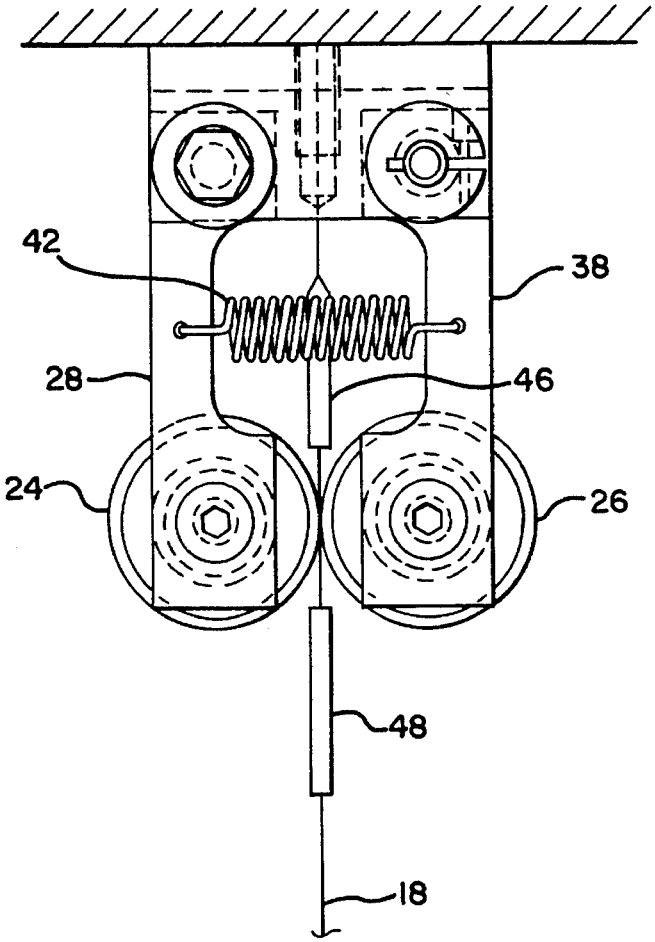
FIG. 4B is a side view showing the protrusions that extend from the internal guide that guides the web of material on top and bottom of the pinch rollers.

The bottom of the internal guide 18 is preferably provided with a pair of opposite, spaced forming plates 50 and 52. The plates 50 and 52 are shaped and sized to extend between creases formed in the tube 44. For example, the plates 50 and 52, as shown in FIG. 7, would extend within the tube 44 as shown in FIG. 5 after the tube has exited the four creasing devices 22. The plates 50 and 52 are sized to retain the tube 44, without stretching the film thereof, as the sealing apparatus 20 is engaged to tuck, sever and seal the tube 44 to form succeeding packages.

In operation, film is passed over the forming shoulder 12 of the form, fill and seal apparatus 10 to form a tube and establish the size of an ensuing package. The tube is advanced by the feeding belt arrangements 14 and 16, and is loosely fitted over the internal guide 18. As the tube passes down the internal guide 18, the protrusions 46 and 48 direct the film of the tube 44 between the pairs of pinch rollers 24 and 26 of each of the creasing devices 22. The internal guide 18 is smaller in dimension than the tube formed by the forming shoulder 12, and therefore as the tube passes over the protrusions 46 and 48, the protrusions are able to properly guide the film between the pinch rollers 24 and 26, thus forming pronounced creases in the tube 44.

At the bottom of the internal guide 18, the forming plates 50 and 52 engage the tube 44 in the four creases formed by the creasing devices 22. The sealing apparatus 20 is then activated to tuck the film of the tube 44 and seal the tube to form the bottom of a package. The package is then filled and advanced in a conventional fashion, and the process is repeated.

The creasing devices 22 according to the invention forms sharp creases in a tube, unlike prior art devices which form little or no crease in the typical film. By squeezing the film between a pair of pinch rollers rather than pressing the film against the internal guide, defined creases are formed without stretching, displacing or damaging the film material.

Various changes can be made to the invention without departing from the spirit thereof or scope of the following claims.

What is claimed is:

1. In an apparatus for forming, filling and sealing packages wherein a web of flexible packaging material is fed from a supply and formed into a continuous tube which is advanced vertically, wherein drive means is provided to advance the tube over an internal guide, and wherein product to be packaged in the packaging material is periodically introduced into the tube through the guide, the tube is sealed and the filled and sealed portion of the tube is then severed from succeeding portions of the tube, the improvement comprising means for forming at least one longitudinal crease in the tube, comprising a. a pair of pinch rollers, motion for which is imparted by movement of the packaging material, located adjacent the tube and downstream of a leading edge of the internal guide, b. means mounting said rollers for contact with one another along roller surfaces thereof, and c. means for directing a portion of the tube between the roller surfaces of said pinch rollers to crease the tube against itself between the roller surfaces as the tube is advanced vertically.

2. An apparatus according to claim 1 in which said mounting means comprises a yoke for each pinch roller, and including means for biassing said rollers toward one another.

3. An apparatus according to claim 1 in which said means for directing comprises a protrusion extending from said internal guide in alignment with said rollers.

4. An apparatus according to claim 1 including four pairs of said pinch rollers spaced about said internal guide to form four creases in the tube.

5. An apparatus according to claim 1 including opposite spaced forming plates secured to a bottom end of said guide, said plates being shaped and sized to extend between spaced creases formed in the tube.

6. An apparatus according to claim 2 in which at least one of said yokes is pivotal, and said biassing means comprises an extension spring connected between said yokes.

7. An apparatus according to claim 3 including a pair of said protrusions one of said protrusions being located upstream of said rollers and the other of said protrusions being located downstream of said rollers, said protrusions being aligned with one another.

8. The method of forming at least one longitudinal crease in a tube of flexible packaging material wherein the tube is formed in a process from a web of the material, then advanced by drive means over an internal guide, and then filled and sealed into individual packages, the method of forming the crease comprising the steps of a. forming the tube such that the tube over the internal guide, b. extending a portion of the advancing tube outwardly from the internal guide, and c. creasing the extended portion against itself between a pair of pinch rollers to form a longitudinal crease in the tube, the pinch rollers being located downstream of a leading edge of the internal guide, and motion for the pinch rollers being imparted by movement of the packaging material.

* * * * *